US007632081B2

(12) United States Patent
Yoo et al.

(10) Patent No.: US 7,632,081 B2
(45) Date of Patent: Dec. 15, 2009

(54) OIL RETRIEVING STRUCTURE FOR A COMPRESSOR

(75) Inventors: Byung Kil Yoo, Seoul (KR); Chul Su Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/604,880

(22) Filed: Nov. 28, 2006

(65) Prior Publication Data

US 2007/0160488 A1 Jul. 12, 2007

(30) Foreign Application Priority Data

Nov. 28, 2005 (KR) ..... 10-2005-0113935

(51) Int. Cl.
*F04C 15/00* (2006.01)
*F04C 27/02* (2006.01)

(52) U.S. Cl. ..... 418/88; 418/55.6; 418/94; 418/97; 418/270; 418/DIG. 1; 184/6.16; 184/6.18

(58) Field of Classification Search ..... 418/88, 418/94, 55.1–55.6, 57, 100, 270, DIG. 1, 418/97–99; 417/310, 410.5, 902; 184/6.16–6.18, 184/6.23

See application file for complete search history.

(56) References Cited

U.S. PATENT DOCUMENTS

| | | | | | |
|---|---|---|---|---|---|
| 3,796,522 | A | * | 3/1974 | Oshima et al. | 418/88 |
| 4,343,599 | A | * | 8/1982 | Kousokabe | 418/55.6 |
| 5,466,136 | A | * | 11/1995 | Yamada et al. | 418/55.6 |
| 6,135,738 | A | * | 10/2000 | Kajiwara et al. | 418/55.6 |

FOREIGN PATENT DOCUMENTS

| | | | | | |
|---|---|---|---|---|---|
| JP | 02211396 | A | * | 8/1990 | 418/55.6 |
| JP | 05141201 | A | * | 6/1993 | 418/55.6 |
| JP | 10037870 | A | * | 2/1998 | |
| JP | 2000080990 | A | * | 3/2000 | |
| JP | 2000120569 | A | * | 4/2000 | |

* cited by examiner

*Primary Examiner*—Theresa Trieu
(74) *Attorney, Agent, or Firm*—KED & Associates, LLP

(57) ABSTRACT

A scroll compressor is provided. The scroll compressor includes a casing, an oil pump, an oil retrieving port, and an oil retrieving unit. The casing has a fluid storage area in a lower portion thereof. The oil pump is provided in the lower portion of the casing, and has a suction unit which suctions fluid from the fluid storage area. The oil retrieving port is in the casing to allow oil retrieved from an external oil separator to flow into the casing. The oil retrieving unit is connected to the oil retrieving port and provides a path which directs the retrieved oil to the suction unit.

24 Claims, 9 Drawing Sheets

OIL RETRIEVING STRUCTURE FOR A COMPRESSOR

BACKGROUND

1. Field

The field relates to a compressor, and more particularly, to a scroll compressor capable of performing an oil pumping operation under a low temperature heating operation condition.

2. Background

A compressor converts mechanical energy into compressive energy. Compressors are classified into reciprocating, scroll, centrifugal, and vane types. Scroll compressors may be further divided into low pressure scroll type compressors and high pressure scroll type compressors based on whether suction gas or discharge gas is filled inside a casing thereof.

BRIEF DESCRIPTION OF THE DRAWINGS

The embodiments will be described in detail with reference to the following drawings in which like reference numerals refer to like elements wherein.

DETAILED DESCRIPTION

Reference will now be made in detail to various embodiments, examples of which are illustrated in the accompanying drawings. Wherever possible, the same reference numbers will be used throughout the drawings and accompanying description thereof refer to the same or like parts. Although a scroll compressor is presented, merely for ease of discussion, it is well understood that the embodiments as broadly described herein may be applied to different types of compressors, as well as other applications which require fluid pumping.

Figure 1:
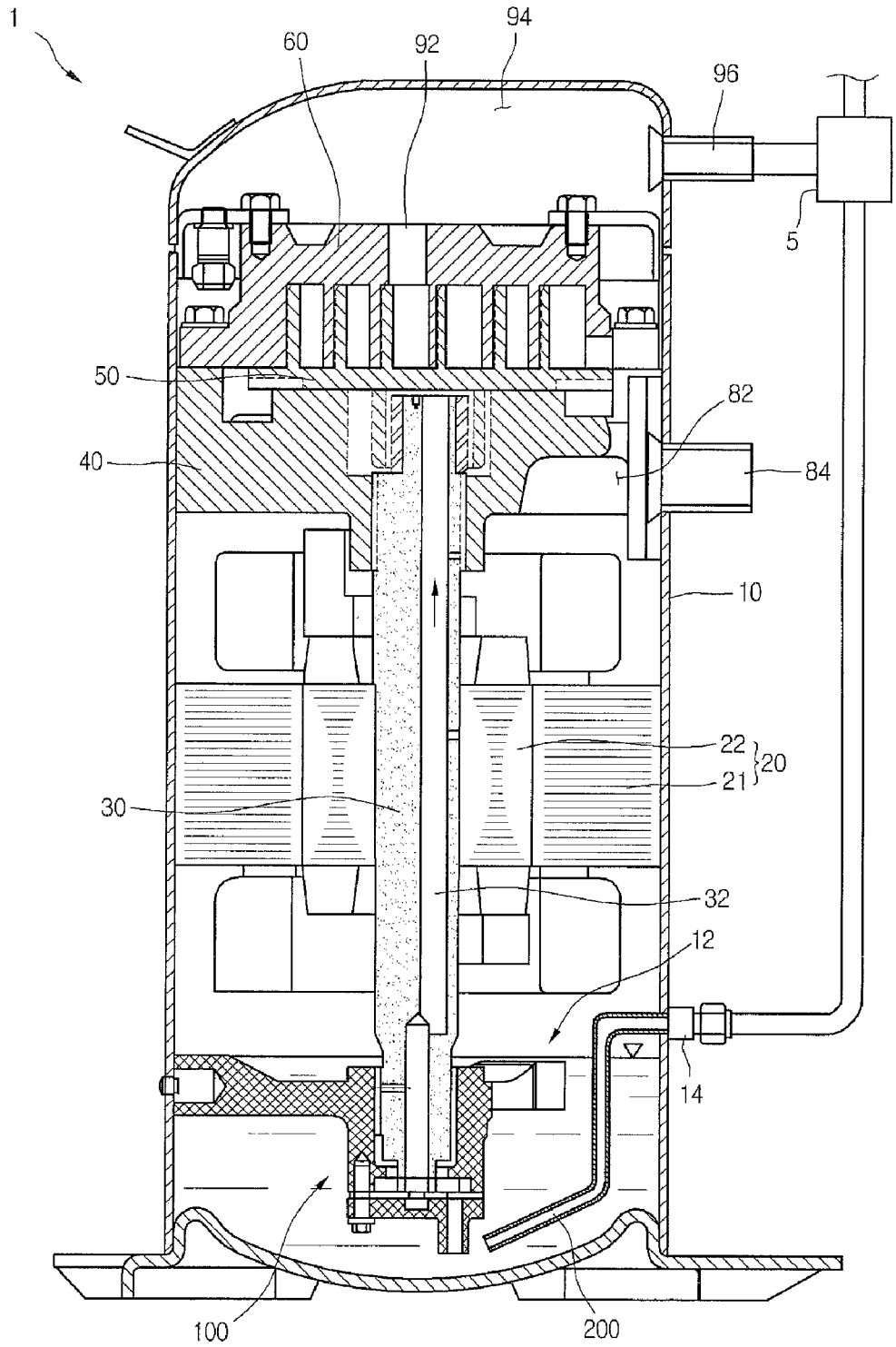
FIG. 1 is a sectional view of an exemplary scroll compressor.

Referring to FIG. 1, the exemplary scroll compressor 1 includes a casing 10 forming an external shape, a driving unit disposed in the casing 10 to generate a rotational force, a suction unit which draws fluid in from the outside, a scroll compressing unit which compresses fluid provided by the suction unit, a discharge unit which discharges the high pressure fluid compressed by the scroll compressing unit, and an oil pump 100 which supplies oil into the scroll compressing unit.

More specifically, the driving unit includes a driving motor 20 having a stator 21 and a rotor 22 disposed inside the stator 21, and a driving shaft 30 inserted into the center of the driving motor 20 which rotates based on rotation of the motor 20. A supplying passage 32 penetrates the driving shaft 30, such that oil pumped by an oil pump 100 may flow up through the driving shaft 30 towards the scroll compressing unit. The suction unit includes a suction pipe 84 formed at one side of the casing 10, and a suction chamber 82 connected to the suction pipe 84 in which fluid drawn in through the suction pipe 84 is accumulated.

The scroll compressing unit includes a top frame 40, a rotating scroll 50, a fixed scroll 60, and an Oldham-ring (not shown). The top frame 40 is coupled to the top of the driving shaft 30 so as to support the driving shaft 30. The rotating scroll 50 is disposed on the top frame 40 so as to compress fluid drawn in through the suction pipe 84. The fixed scroll 60 engages with the rotating scroll 50 and is fixed on the top frame 40. The Oldham-ring (not shown) allows the rotating scroll 50 to rotate with respect to the fixed scroll 60.

The discharge unit includes a discharge port 92 formed in the center of the fixed scroll 60 to discharge the compressed fluid, a discharge chamber 94 connected to the discharge port 92 formed near the top of the casing 10, and a discharge pipe 96 connected to the discharge chamber 94 positioned near the top of the casing 10.

The oil pump 100 is positioned near the inner bottom of the casing 10 and pumps oil stored in an oil storage area 12 towards a friction portion of the compressor 1, such as, for example, the components of the scroll compressing unit. An oil retrieving port 14 is provided near the lower portion of the casing 10. The oil retrieving port 14 introduces oil from an oil separating unit 5 connected to the discharge pipe 96 into the oil storage area 12. The oil retrieving unit 200 is connected to the oil retrieving port 14.

Operation of the exemplary scroll compressor 1 will now be described.

First, when the compressor 1 operates, fluid is drawn in through the suction pipe 84. If the compressor 1 is operating in a low temperature heating condition, a low temperature liquid coolant flows in through the suction pipe 84. A portion of the coolant flows into the scroll compressing unit through the suction chamber 82, and the rest of coolant flows into the oil storage area 12.

The coolant in the scroll compressing unit is compressed by a rotating movement of the scrolls 50, 60 and is collected on the center of the scroll 60. The collected high pressure coolant flows into the discharge chamber 94 through the discharge port 92, and then is discharged external to the compressor 1 through the discharge pipe 96.

During compression of the coolant, the oil in the oil storage area 12 is suctioned up into the driving shaft 30 by a pumping operation driven by the rotation of the driving shaft 30, and then supplied to the friction portion of the compressor 1. Since, in this example, the compressor 1 is operating in a low temperature heating condition, the coolant and oil contained in the oil storage area 12 are not mixed, and thus phase-separated, the coolant, which is relatively heavier than the oil, is located at the bottom, and the oil, which is relatively lighter than the coolant, is located on top of the coolant.

During a typical pumping operation of the fluid contained in the oil storage area 12 (in this case, oil and coolant by the oil pump 100), only coolant would be suctioned into the oil pump 100. However, when oil provided by the oil separating unit 5 is discharged into the oil storage area 12 through the oil retrieving port 14 and the oil retrieving unit 200, oil can be drawn into the oil suction unit 142 before the oil, which is lighter than any coolant which may also be present in the oil storage area 12, ascends to a position atop the coolant.

Figure 2:
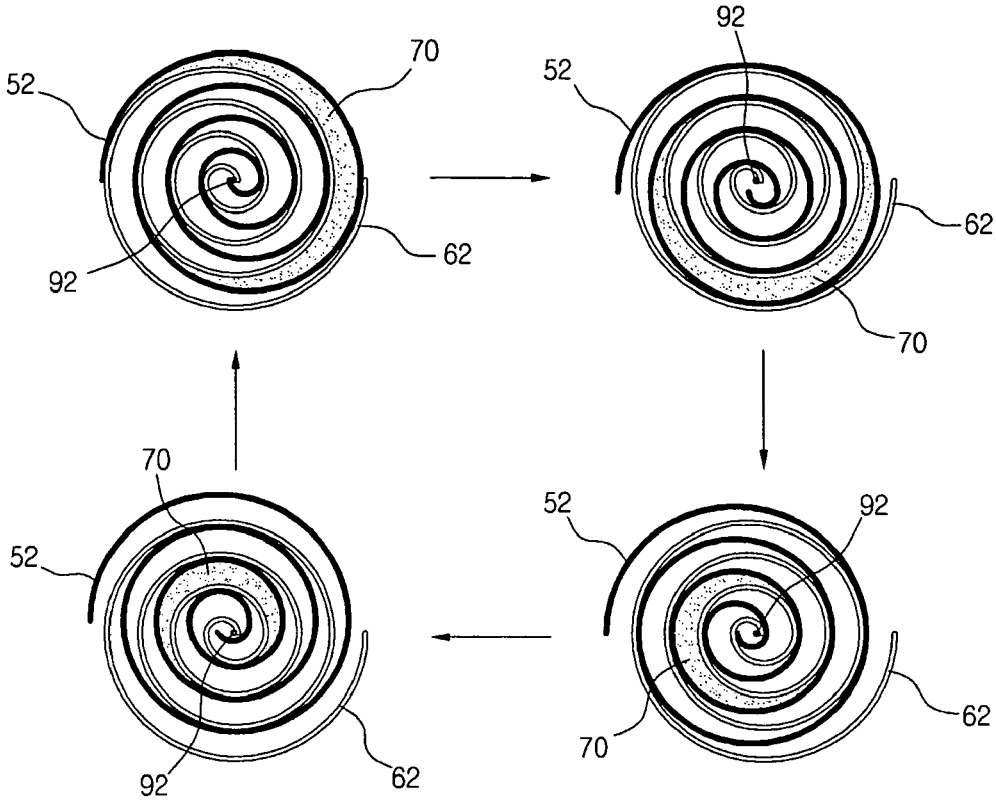
FIG. 2 illustrates a fluid compression operation in the exemplary scroll compressor shown in FIG. 1.

FIG. 2 illustrates the compression of fluid in the exemplary scroll compressor 1. The scroll compressing unit includes a fixed scroll wrap 62 provided below the fixed scroll 60 and formed in a spiral shape, a rotating scroll wrap 52 formed on the rotating scroll 50 in a spiral shape, and a discharge port 92 formed at an inner center of the fixed scroll wrap 62. The rotating scroll wrap 52 is cross-inserted into the fixed scroll wrap 62 such that the wraps 52, 62 rotate together from a mutual disposition of 180°.

The rotating scroll 50 is offset towards the center of the driving shaft 30 for rotation, and rotates with respect to the fixed scroll 60 due to the rotation of the driving shaft 30. This causes surface contact between the rotating scroll wrap 52 and the fixed scroll wrap 62, thereby forming a pocket 70 that compresses the coolant. The volume of the pocket 70 decreases as it approaches the center of the scroll wraps 52, 62, thereby generating a high pressure. The high pressure fluid flows from this pocket 70 into the discharge chamber 94 through the discharge port 92 in the center of the scroll wraps 52, 62.

Figure 3:
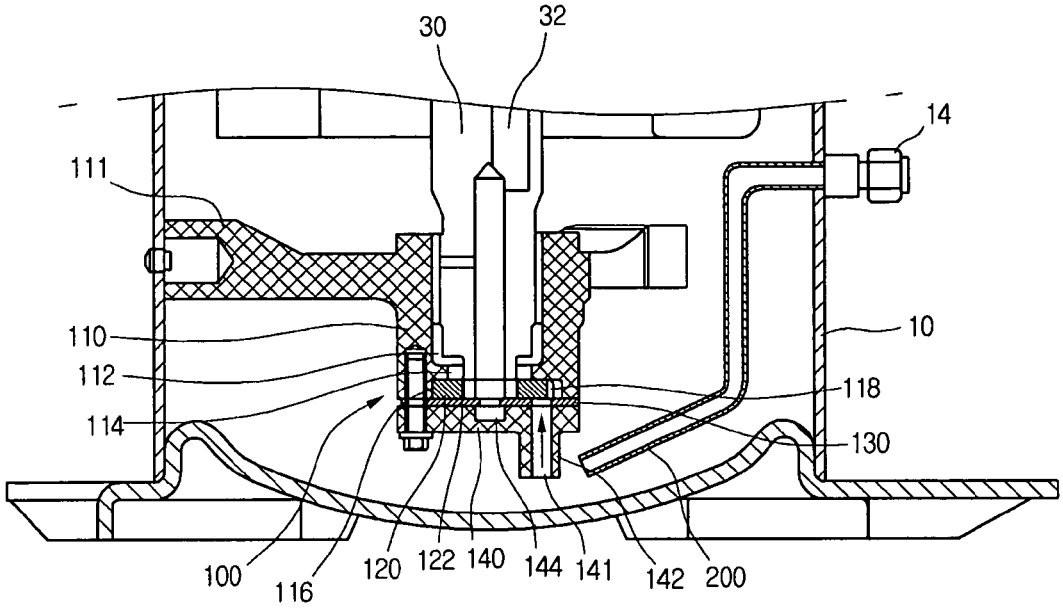
FIG. 3 is a cross-sectional view of an oil supplying structure in accordance with an embodiment as broadly described herein.

FIG. 3 is a cross-sectional view of an oil supplying structure, including a pump body 110 having the driving shaft 30 inserted thereinto, a pumping member 120 inserted into a lower portion of the pump body 110 and connected to a lower portion of the driving shaft 30, a plate 130 mounted on the bottom of the pump body 110 to guide the suction and discharge of oil, a pump cover 140 mounted below the plate 130, and an oil retrieving unit 200 retrieving the oil separated from the oil separating unit. The pump body 110 may be connected near an inner bottom of the casing 10, proximate the oil storage area 12. A plurality of fixing parts 111 extend toward a side direction to fix the pump body 110 to the casing 10.

A driving shaft insertion groove 112 is formed on the pump body 110, and the driving shaft 30 is inserted into the driving shaft insertion groove 112. A driving shaft through hole 114 is formed below the driving shaft insertion groove 112 so as to receive a lower portion of the driving shaft 30. A pumping member insertion groove 116 into which the pumping member 120 is inserted may be formed in a lower portion of the pump body 110, extending from the bottom toward the top.

That is, the driving shaft insertion groove 112, the driving shaft through hole 114, and the pumping member insertion groove 116 are all connected, as shown in FIG. 3. An oil pumping unit 118 is formed between an inner circumference of the pumping member insertion groove 116 and the pumping member 120. Accordingly, when oil flows into the oil pumping unit 118, it goes through a predetermined process due to rotation of the pumping member 120, and then flows into the supplying passage 32 formed in the driving shaft 30.

A driving shaft combining hole 122 where the driving shaft 30 is coupled to the pumping member 120 is formed on the center of the pumping member 120. Accordingly, the pumping member 120 rotates when the driving shaft 30 rotates. The pumping member 120 is fixed to one side of the pump body 110. Accordingly, since the pumping member 120 is fixed to one side of the bump body 110 and rotates with the driving shaft 30, the pumping member 120 does not rotate about its own axis, but rather, revolves about the driving shaft 30.

The plate 130 is substantially circular, and is mounted on the bottom of the pump body 110 to guide the suction and discharge of oil, and to prevent the pumping member 120 from directly contacting the pump cover 140. A pump cover 140 positioned below the plate 130 is connected to the pump body 110. An oil suction unit 142 extends downward from the pump cover 140 to draw in oil stored in the oil storage area 12. Oil drawn into the oil suction unit 142 flows through the oil suction passage 141 and into the oil pumping unit 118. The pump cover 140 may be coupled to the pump body 110 at a variety of locations such that the position of the oil suction unit 142 may be varied based on an installation position of the pump cover 140 on the pump body 110.

A discharge groove 144 formed in the pump cover 140 receives the coolant and oil, which flow by rotation of the pumping member 120 into the driving shaft 30. When the compressor 1 operates in a low temperature heating condition, the oil retrieving unit 200 retrieves oil from an external source, and the retrieved oil flows into the oil suction unit 142 to prevent only the coolant from being drawn into the oil suction unit 142. The oil retrieving unit 200 may have a pipe shape, with one end connected to the oil retrieving port 14 and the other end disposed adjacent to or below the oil suction unit 142 to smoothly direct the retrieved oil towards the oil suction unit 142.

A process of pumping oil when the coolant and oil are separated will be described in more detail with reference to FIG. 4. When coolant and oil are mixed, and not separated, in the oil storage area 12 and the pumping member 120 rotates with the driving shaft 30, the mixed coolant and oil are suctioned in through the oil suction unit 142 due to a pressure difference generated by the pumping member 120. The mixed coolant and oil flow into the oil pumping unit 118 along the oil suction passage 141, and ascend along the supplying passage 32 through a predetermined pumping process. The oil stored in the oil storage area 12 and the oil retrieved by the oil retrieving unit 200 both flow into the oil suction unit 142.

Figure 4:
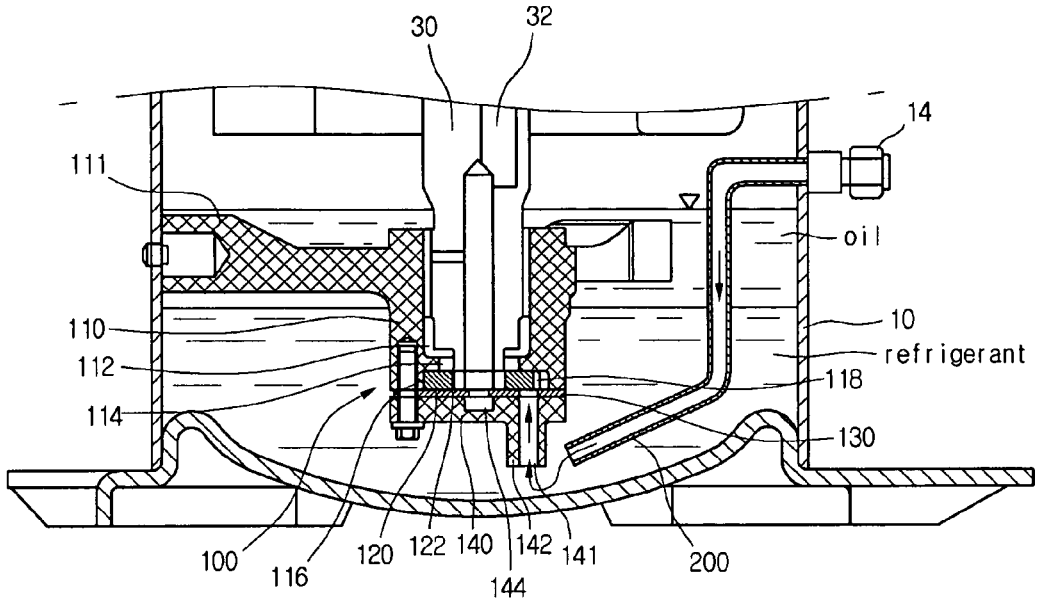
FIG. 4 illustrates how oil is supplied in the structure shown in FIG. 3 when coolant and oil are separated.

However, when the compressor 1 operates in a low temperature heating condition, as shown in FIG. 4, in which the coolant and oil stored in the oil storage area 12 are not mixed, and thus phase-separated, the coolant is located near the bottom of the storage area 12, as it is heavier than the oil, and the oil is located on top of the coolant, as it is lighter than the coolant.

When only coolant is drawn into the oil suction unit 142, the oil retrieved from the oil retrieving unit 200 is discharged into the storage area 12 near the oil suction unit 142. Thus, before the oil is able to ascend above the coolant, it is sucked into the oil suction unit 142. Thus, oil, or a mixture of coolant and oil, flow into the oil suction unit 142, rather than just coolant, thus providing improved lubrication to the friction portion of the compressor 1.

In this manner, although the coolant and oil in the oil storage area 12 are phase-separated, the oil discharged from the oil retrieving unit 200 can flow into the oil suction unit 142, thus providing oil and sufficient lubrication to the friction portion of the compressor.

Additionally, since oil is continuously supplied, the scroll compressing unit operates smoothly. As a result, wear and damage of the scroll compressing unit can be prevented, thereby improving capacity and reliability of the compressor.

Figure 5:
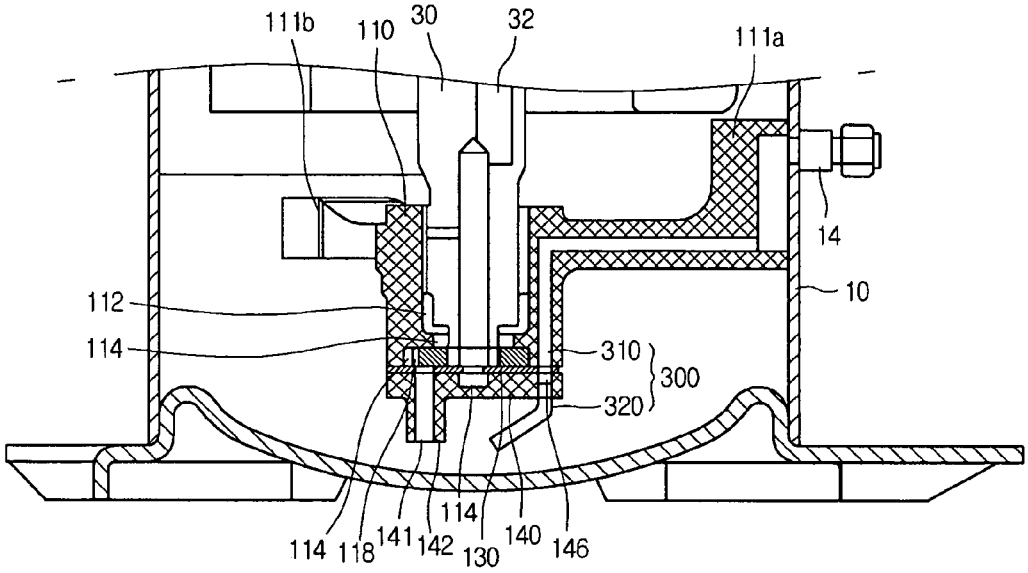
FIG. 5 is a cross-sectional view of an oil supplying structure in accordance with another embodiment as broadly described herein.

FIG. 5 is a cross-sectional view of an oil supplying structure in accordance with another embodiment. This embodiment is almost identical to the first embodiment except for an oil retrieving structure as broadly described herein. The oil supplying structure as shown in FIG. 5 includes a pump body 110 having a driving shaft 30 inserted thereinto, a pumping member 120 inserted below the pump body 110 and connected to a lower end of driving shaft 30, a plate 130 mounted below the pump body 110 to guide the suction and discharge of oil, and a pump cover 140 mounted below the plate 130.

The oil supplying structure also includes an oil retrieving unit 300. The oil retrieving unit 300 includes an oil retrieving passage 310 formed in the pump body 110 to retrieve oil separated by an oil separator (not shown in FIG. 5), and an oil retrieving pipe 320 connected to the oil retrieving passage 310 to allow the retrieved oil to flow into the oil suction unit 142 of the pump cover 140.

A plurality of fixing units 111 extend outward from the pump body 110 toward the casing 10 so as to fix the pump body 110 to the casing 10. One fixing unit 111*a* among the fixing units 111 is formed larger than the rest of them, extending up to the height of the oil retrieving port 14, and coupled to the oil retrieving port 14. In this embodiment, the installation position of the pump cover 140 connected to the pump body 110 is different from FIG. 3. Accordingly, the position and/or orientation of the oil suction unit 142 is different.

An oil retrieving passage 310 connected to the oil discharge port 14 is formed inside the pump body 110. A pipe insertion hole 146 where the oil retrieving pipe 320 is inserted is formed in the pump cover 140. The pipe insertion hole 146 is connected to a portion of the oil retrieving passage 310. One end of the oil retrieving pipe 320 is inserted into the pipe insertion hoe 146, and the other end is disposed adjacent to or below the oil suction unit 142.

Accordingly, oil received in the oil retrieving port 14 passes through the oil retrieving passage 310, and then is discharged near the oil suction unit 142 by the oil retrieving pipe 320. Therefore, the oil flows into the oil suction unit 142. The structure of this embodiment simplifies assembly of the oil supplying structure. More specifically, in the first embodiment, the oil retrieving unit 200 is connected and then the oil pump 100 is installed, or the oil pump 100 is installed and then the oil retrieving unit 200 is connected in a limited space at an inner lower portion of the compressor 1. In contrast, in this embodiment, since the oil pump 100 is installed on an inner lower portion of the casing 10 when the oil retrieving pipe 320 is inserted into the pump cover 140, assembly is simplified.

Figure 6:
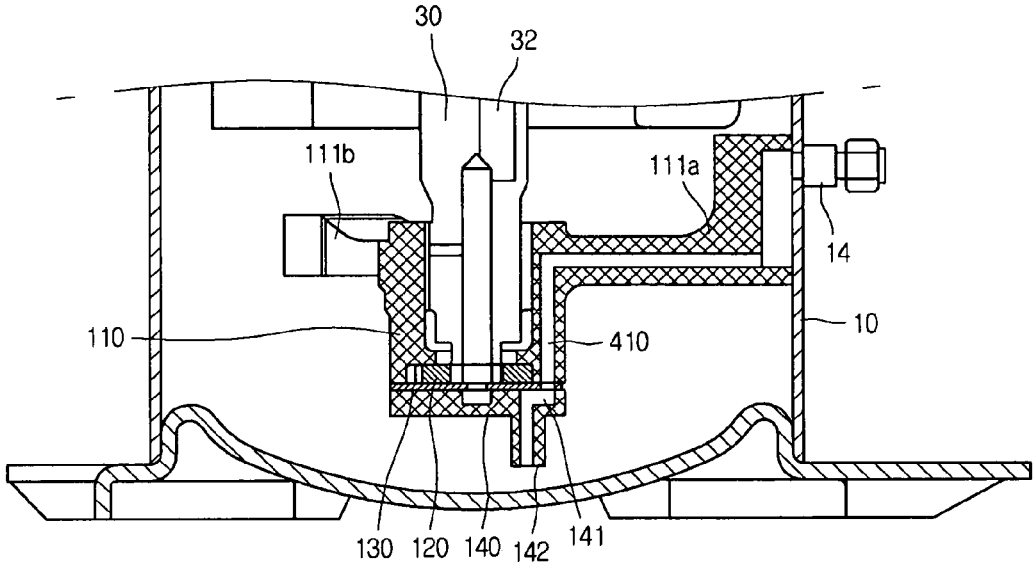
FIG. 6 is a cross-sectional view of an oil supplying structure in accordance with another embodiment as broadly described herein.

FIG. 6 is a cross-sectional view of an oil supplying structure in accordance with another embodiment as broadly described herein. The oil supplying structure shown in FIG. 6 includes a pump body 110 having the driving shaft 30 inserted thereinto, a pumping member 120 inserted into a lower portion of the pump body 110 and connected to a lower portion of the driving shaft 30, a plate 130 mounted below the pump body 130 to guide the suction and discharge of oil, a pump cover 140 mounted below the plate 130, and an oil retrieving passage 410 formed inside the pump body 110 to allow oil provided by the oil separator to flow into the oil suction passage 141 of the pump cover 140.

In this embodiment, one end of the oil retrieving passage 410 is connected to the oil retrieving port 14, and the other end is connected to the oil suction passage 141. This end of the oil retrieving passage 141 is in turn connected to the oil pumping unit 118, thus allowing the oil to flow into the oil pumping unit 118.

Accordingly, the retrieved oil is not discharged into the oil storage area 12, but rather flows directly into the oil suction passage 141. Therefore, the entire quantity of the retrieved oil can be pumped, and thus a large amount of oil can be supplied.

Moreover, since the pressure of the oil received in the oil retrieving port 14 is high, and the high pressure oil flows directly into the oil suction passage 141, the pressure of the oil suction passage 141 increases. Therefore, oil supply performance improves.

Figure 7:
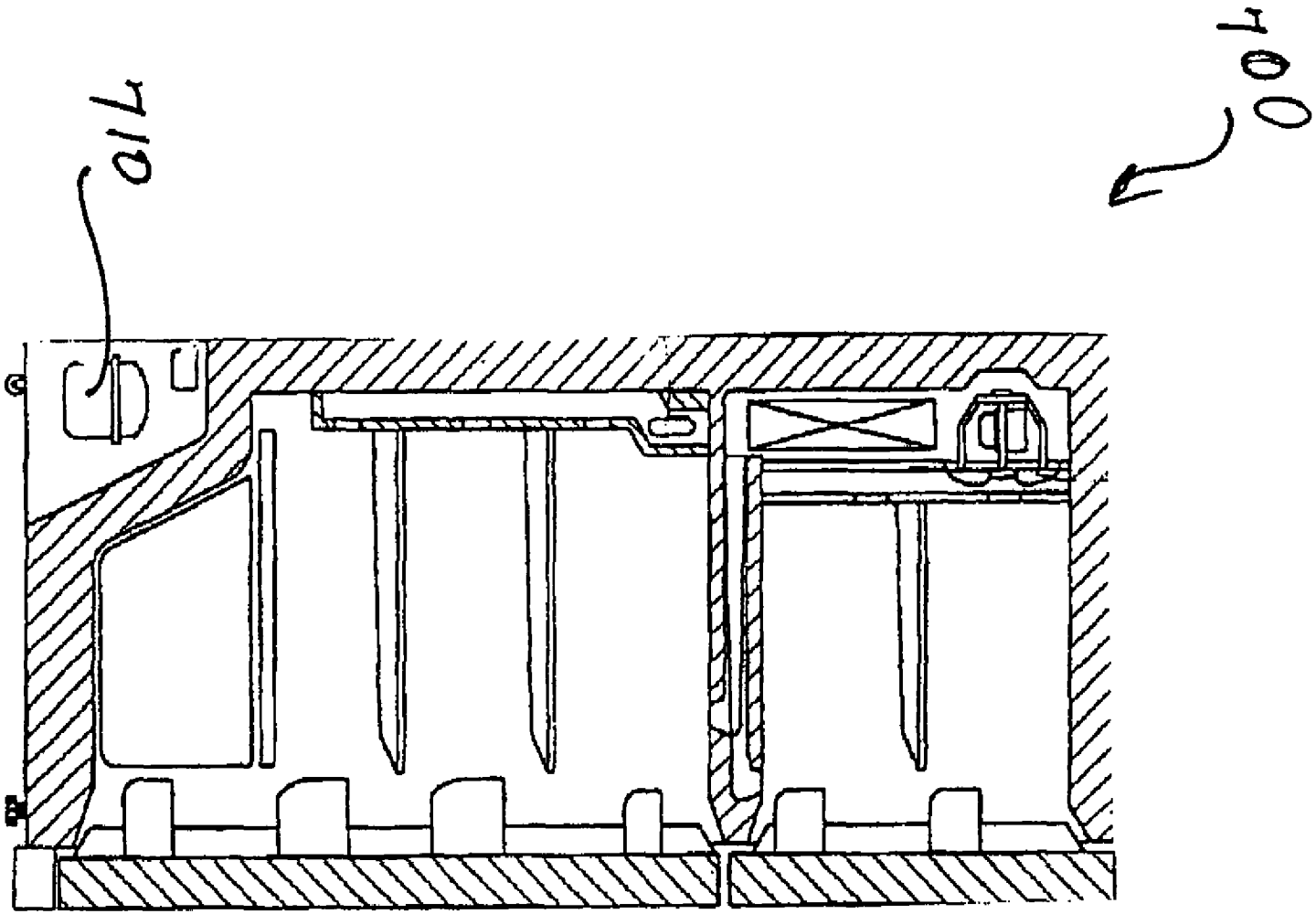
FIGS. 7-9 illustrate exemplary installations of a compressor as embodied and broadly described herein.

The oil pump for a compressor as embodied and broadly described herein has numerous applications in which compression of fluids is required, and in different types of compressors. Such applications may include, for example, air conditioning and refrigeration applications. One such exemplary application is shown in FIG. 7, in which a compressor 710 as embodied and broadly described herein is installed in a refrigerator/freezer 700. Installation and functionality of a compressor in this type of refrigerator is discussed in detail in U.S. Pat. Nos. 7,082,776, 6,995,064, 7,14,345, 7,055,338 and 6,772,601, the entirety of which are incorporated herein by reference.

Figure 8:
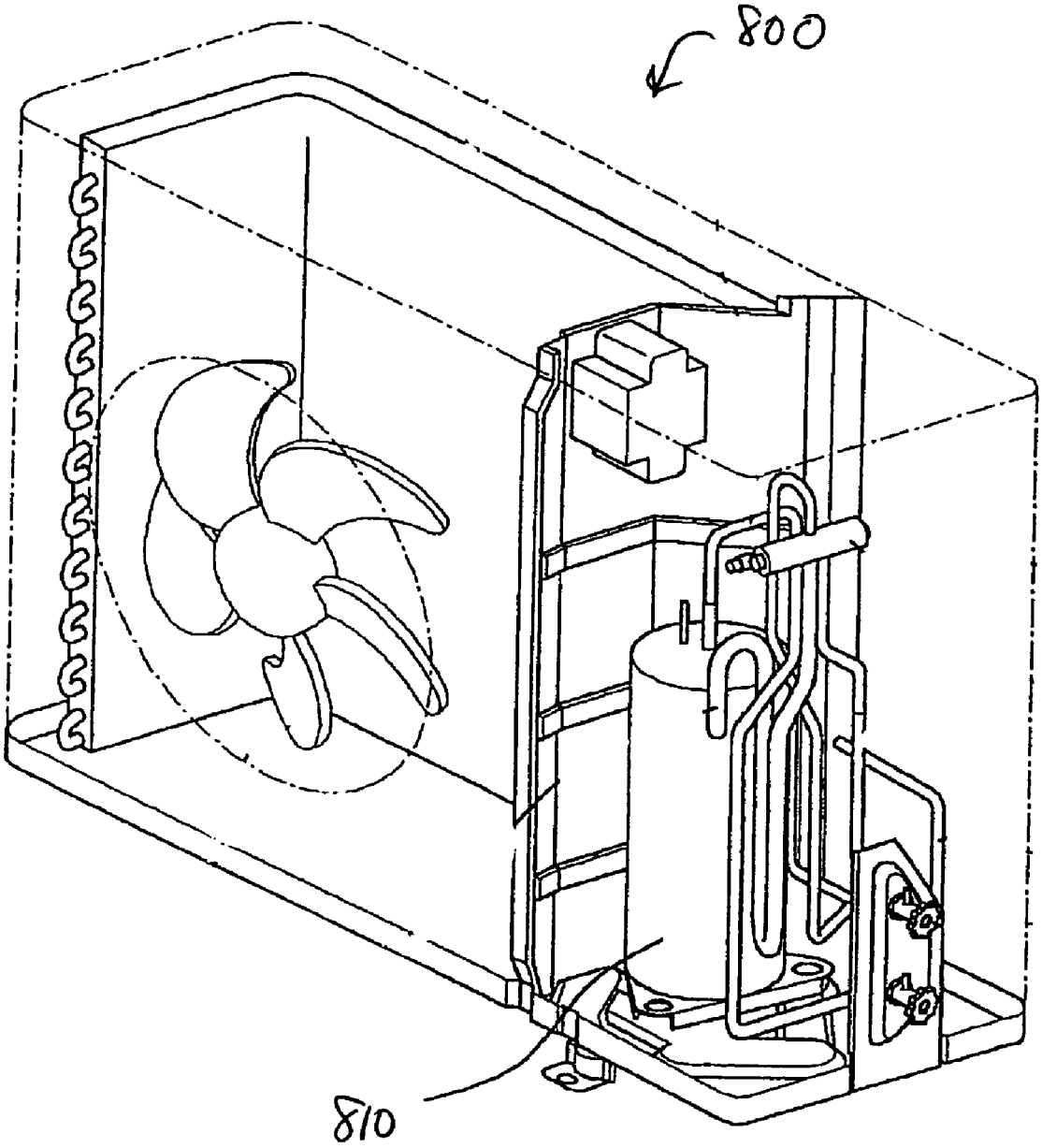

Another such exemplary application is shown in FIG. 8, in which a compressor 810 as embodied and broadly described herein is installed in an outdoor unit of an air conditioner 800. Installation and functionality of a compressor in this type of air conditioner is discussed in detail in U.S. Pat. Nos. 7,121, 106, 6,868,681, 5,775,120, 6,374,492, 6,962,058, 6,951,628 and 5,947,373, the entirety of which are incorporated herein by reference.

Figure 9:
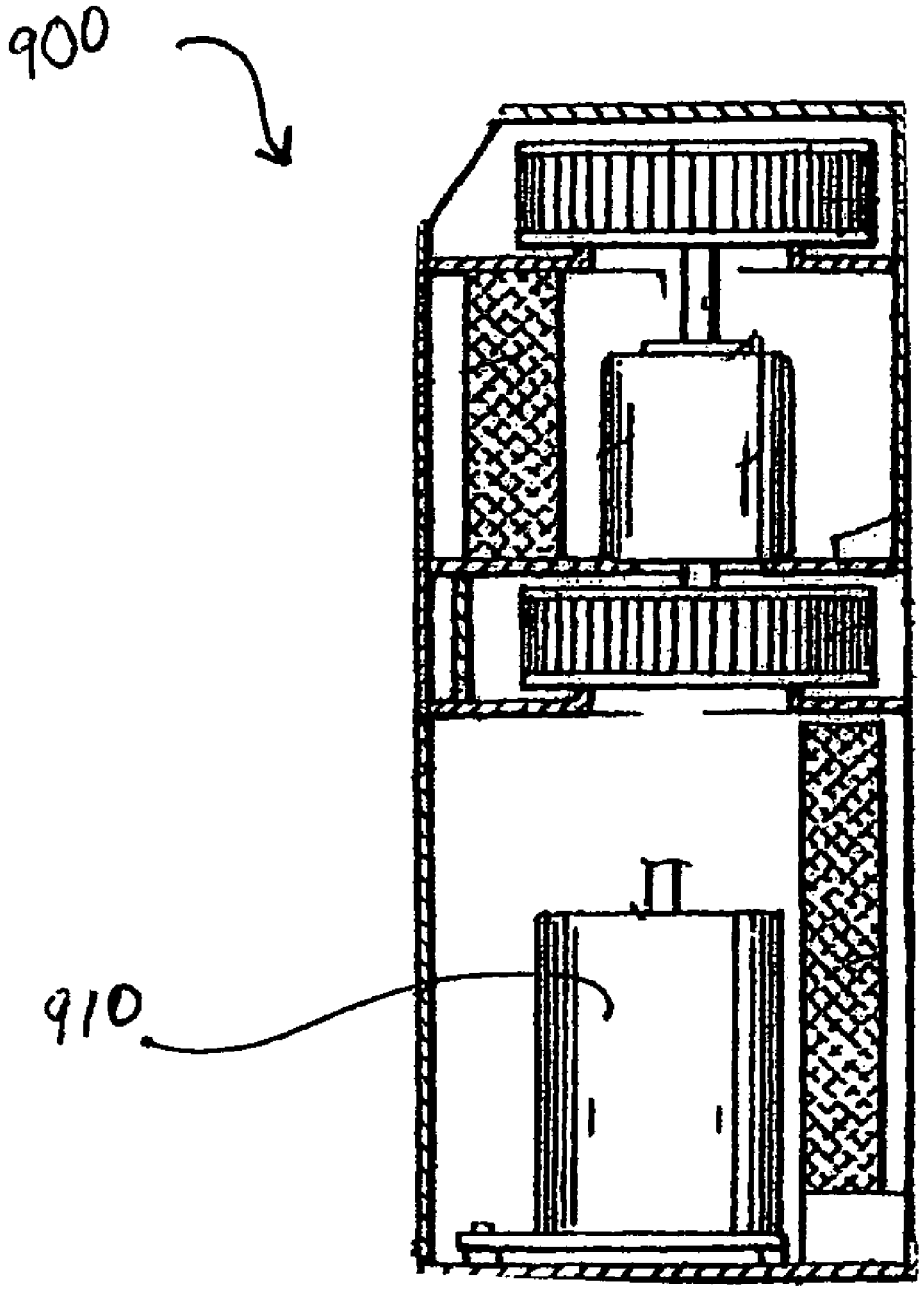

Another such exemplary application is shown in FIG. 9, in which a compressor 910 as embodied and broadly described herein is installed in a single, integrated air conditioning unit 900. Installation and functionality of a compressor in this type of air conditioner is discussed in detail in U.S. Pat. Nos. 7,032,404, 6,412,298, 7,036,331, 6,588,288, 6,182,460 and 5,775,123, the entirety of which are incorporated herein by reference.

Likewise, the oil pumping system as embodied and broadly described herein is not limited to installation in compressors. Rather, the oil pumping system as embodied and broadly described herein may be applied in any situation in which this type of fluid pumping is required and/or advantageous.

Accordingly, the present invention is directed to a scroll compressor that substantially obviates one or more problems due to limitations and disadvantages of the related art.

An object is to provide a scroll compressor capable of supplying oil even though the coolant and oil stored in an oil storage unit is phase-separated under a low temperature heating operation condition.

Another object is to provide a scroll compressor which prevents wear and damage because a friction portion operates smoothly due to a smooth oil supply.

To achieve these objects and other advantages and in accordance with the purpose of embodiments as broadly described herein, there is provided a scroll compressor including, a casing, an oil pump, an oil retrieving port, and an oil retrieving unit. The casing has an oil storage unit therebelow. The oil pump is provided on an inner lower portion of the casing and having a suction unit suctioning fluid stored in the oil storage unit. The oil retrieving port is formed on the outside of the casing to inflow oil retrieved from an external oil separator. The oil retrieving unit is connected to the oil retrieving port and providing a path to inflow the retrieved oil into the suction unit.

In certain embodiments the compressor operates under a low temperature heating operation condition even when coolant and oil in the oil storage unit are phase-separated. Since the oil is retrieved by an oil retrieving unit to discharge into an oil pick-up unit in a pump cover, or to directly flow into the oil pumping unit, coolant is prevented from flowing into the oil pumping unit.

Additionally, since oil flows into an oil pumping unit, it is continuously supplied into a friction portion.

Moreover, since oil is evenly distributed to thoroughly lubricate the friction portion, performance and reliability of the compressor improve.

It is to be understood that both the foregoing general description and the following detailed description of the present invention are exemplary and explanatory and are intended to provide further explanation of the invention as claimed.

Any reference in this specification to "one embodiment," "an exemplary," "example embodiment," "certain embodiment," "alternative embodiment," and the like means that a particular feature, structure, or characteristic described in connection with the embodiment is included in at least one embodiment as broadly described herein. The appearances of such phrases in various places in the specification are not necessarily all referring to the same embodiment. Further, when a particular feature, structure, or characteristic is described in connection with any embodiments, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, numerous variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A compressor, comprising:

a casing having a fluid storage area in a lower portion thereof, and a discharge pipe that discharges compressed fluid from the casing;

a driving unit provided in the casing to generate a driving force;

a suction unit that draws fluid into the casing from an external source;

a compressing unit that compresses fluid provided by the suction unit;

a discharging unit that discharges compressed fluid from the compressor; and an oil retrieving structure that provides oil to the compressing unit, comprising:

an oil pump provided in the lower portion of the casing, wherein the oil pump includes a fluid suction device that suctions fluid only from fluid stored in the fluid storage area;

an oil retrieving port provided at a wall of the casing, wherein the oil retrieving port introduces retrieved oil into the casing, wherein the retrieved oil is separated from the compressed fluid discharged through the discharge pipe; and an oil retrieving unit connected to the wall of the casing, the oil retrieving unit comprising a path that extends from the oil retrieving port toward the fluid suction device of the oil pump, and that discharges the retrieved oil proximate the fluid suction device.

2. The compressor according to claim 1, wherein a first end of the path formed by the oil retrieving unit is connected to the oil retrieving port at the wall of the casing, and a second end of the path is disposed adjacent to the fluid suction device.

3. The compressor according to claim 1, wherein the oil retrieving unit comprises:

an oil retrieving passage formed inside the oil pump, with an inlet end thereof connected to the oil retrieving port at the wall of the casing; and an oil retrieving pipe having a first end coupled to the oil pump.

4. The compressor according to claim 3, wherein a second end of the oil retrieving pipe is disposed adjacent to the fluid suction device.

5. The compressor according to claim 3, wherein the oil pump comprises at least one fixing unit that fixes the oil pump to the casing, wherein a portion of the oil retrieving passage is formed in the fixing unit.

6. The compressor according to claim 1, wherein the oil retrieving unit is formed inside the oil pump, and wherein the path in the oil retrieving unit has one end connected to the oil retrieving port and the other end connected to the fluid suction device.

7. The compressor according to claim 6, wherein the oil pump comprises at least one fixing unit that fixes the oil pump to the casing, wherein a portion of the oil retrieving passage is formed on the fixing unit.

8. The compressor according to claim 1, wherein the oil retrieving unit discharges oil into the fluid suction device.

9. The compressor according to claim 1, wherein the oil pump comprises:

a pump body coupled to a driving shaft;

a pumping member coupled to a lower portion of the pump body such that the pumping member rotates with the driving shaft; and a pump cover coupled to the pump body below the pumping member, the pump cover including the fluid suction device, wherein the oil retrieving unit is formed on the pump body.

10. The compressor according to claim 9, wherein the oil retrieving unit is coupled to the fluid suction device.

11. The compressor according to claim 1, wherein the compressor is a scroll compressor.

12. The compressor according to claim 1, wherein the fluid stored in the fluid storage area is oil or a combination of oil and refrigerant.

13. The compressor according to claim 1, wherein the oil pump and the oil retrieving unit are provided in the casing.

14. The compressor according to claim 1, wherein the oil pump directs the fluid drawn in by the fluid suction device from the fluid storage area and the oil retrieving unit up through a shaft of the driving unit and into the compressing unit.

15. The compressor according to claim 14, wherein fluid is drawn into the oil pump and directed up through the shaft to the compressing unit by rotation of the shaft.

16. A compressor, comprising:

a casing having a fluid storage area formed therein, and a discharge pipe that discharges compressed fluid from the casing;

a driving unit, a compressing unit, a suction unit, and a discharge unit provided within the casing so as to suction fluid into the casing, compress the suctioned fluid, and discharge the compressed fluid out of the casing; and an oil retrieving structure that provides fluid to the compressing unit, comprising:

a pump body coupled to the casing;

a pumping member inserted into the pump body;

a pump cover coupled to the pump body, the pump cover including a fluid suction device that suctions fluid only from fluid stored in the fluid storage area;

an oil retrieving port provided at a wall of the casing, wherein the discharge pipe introduces compressed fluid from the casing into an external oil separator, and the oil retrieving port receives retrieved oil separated the compressed fluid in the external oil separator and introduces the retrieved oil into the casing; and an oil retrieving unit that connected to an inner surface of the casing, wherein the oil retrieving unit forms a path extending from the inner surface of the casing to the fluid suction device, with a first end of the path connected to the oil retrieving port so as to receive oil from the oil retrieving port, and a second end of the path positioned proximate the fluid suction device so as to discharge the oil proximate an inlet into the fluid suction device.

17. The compressor according to claim 16, wherein the compressor is a scroll compressor.

18. The compressor according to claim 16, wherein the fluid stored in the fluid storage area is oil or a combination of oil and refrigerant.

19. The compressor according to claim 16, wherein the oil pump directs the fluid drawn in by the fluid suction device from the fluid storage area and the oil retrieving unit up through a shaft of the driving unit and into the compressing unit.

20. The compressor according to claim 19, wherein fluid is drawn into the oil pump and directed up through the shaft to the compressing unit by rotation of the shaft.

21. The compressor according to claim 16, wherein the pump body, the pumping member, the pump cover and the oil retrieving unit are all provided in the casing.

22. An oil retrieving structure for a compressor having a driving unit, a suction unit, a compression unit and a discharge unit provided in a casing, the oil retrieving structure comprising:

an oil pump provided in a lower portion of the casing, wherein the oil pump draws in fluid only from a fluid storage area formed in the lower portion of the casing into the oil pump through a fluid suction device, and directs the fluid to the compression unit;

an oil retrieving port formed in an external wall of the casing and coupled to an external oil separator, wherein the external oil separator is connected to a compressed fluid discharge pipe that extends through the external wall of the casing, wherein the discharge pipe introduces compressed fluid into the external oil separator, and the oil retrieving port receives retrieved oil separated from the compressed fluid in the external oil separator and introduces the retrieved oil into the casing; and an oil retrieving unit coupled to the external wall of the casing, wherein the oil retrieving unit receives oil from the external oil separator via the oil retrieving port, and that discharges the received oil proximate an inlet into the fluid suction device of the oil pump.

23. The oil retrieving structure of claim 22, wherein the oil retrieving unit includes a passage having a first end coupled to the oil retrieving port at an inner side of the casing, and a second end that forms a discharge port positioned adjacent to the fluid suction device so as to direct the oil from the passage into the fluid suction device.

24. A scroll compressor comprising the oil retrieving structure of claim 22.

* * * * *